US005812159A

United States Patent [19]

Anagnostopoulos et al.

[11] Patent Number: 5,812,159

[45] Date of Patent: Sep. 22, 1998

[54] INK PRINTING APPARATUS WITH IMPROVED HEATER

[75] Inventors: Constantine Nicholas Anagnostopoulos, Mendon; Ravi Sharma, Fairport, both of N.Y.

[73] Assignee: Eastman Kodak Company, Rochester, N.Y.

[21] Appl. No.: 681,021

[22] Filed: Jul. 22, 1996

[51] Int. Cl.[6] ..... B41J 2/06; B41J 2/05

[52] U.S. Cl. ..... 347/55; 347/17; 347/59; 347/56; 347/61

[58] Field of Search ..... 347/17, 54, 55, 347/56, 59, 61, 67, 100

[56] References Cited

U.S. PATENT DOCUMENTS

| | | | |
|---|---|---|---|
| 3,946,398 | 3/1976 | Kyser et al. | 347/70 |
| 4,164,745 | 8/1979 | Cielo et al. | 347/61 |
| 4,166,277 | 8/1979 | Cielo et al. | 347/55 |
| 4,275,290 | 6/1981 | Cielo et al. | 347/61 |
| 4,293,865 | 10/1981 | Jinnai et al. | 347/48 |
| 4,490,728 | 12/1984 | Vaught et al. | 347/60 |
| 4,595,938 | 6/1986 | Conta et al. | 347/55 |
| 4,737,803 | 4/1988 | Fujimura et al. | 347/67 |
| 4,748,458 | 5/1988 | Inoue et al. | 347/67 |
| 4,751,531 | 6/1988 | Saito et al. | 347/55 |
| 4,751,532 | 6/1988 | Fujimura et al. | 347/55 |
| 4,894,664 | 1/1990 | Tsung Pan | 347/63 |
| 4,922,265 | 5/1990 | Pan | 347/47 |
| 5,097,275 | 3/1992 | Takita | 347/56 |
| 5,400,061 | 3/1995 | Horio et al. | 347/55 |
| 5,635,966 | 6/1997 | Keefe et al. | 347/43 |

FOREIGN PATENT DOCUMENTS

| | | |
|---|---|---|
| 62-271753 | 11/1987 | Japan . |
| 2 007 162 A | 10/1978 | United Kingdom . |

*Primary Examiner*—Peter S. Wong
*Assistant Examiner*—Patrick B. Law
*Attorney, Agent, or Firm*—Milton S. Sales

[57] ABSTRACT

A liquid ink, drop-on-demand printhead includes a substrate having a plurality of drop-emitter orifices, an ink channel coupled to each of the orifices for delivery of a body of ink to the orifices at a pressure above ambient, thereby forming an ink meniscus at the orifices. Drop selection is effected by selectively delivering heat to ink which has been delivered to selectively addressed ones of the orifices, thereby causing a difference in meniscus position between ink in addressed and non-addressed orifices. A heater is suspended in each ink meniscus close to its surface when the meniscus is at its position in a non-addressed orifice, the heater being effective to heat the meniscus and to thereby reduce surface tension of the meniscus at selectively addressed orifices.

10 Claims, 3 Drawing Sheets

INK PRINTING APPARATUS WITH IMPROVED HEATER

CROSS-REFERENCE TO RELATED APPLICATIONS

Reference is made to Commonly assigned U.S. Pat. application Ser. No. 08/621,754 filed in the name of Kia Silverbrook on Mar. 22, 1996, now abandoned.

BACKGROUND OF THE INVENTION

1. Technical Field

This invention relates generally to the field of digitally controlled printing devices, and in particular to liquid ink drop-on-demand printheads which integrate multiple orifices on a single substrate and in which a liquid drop is selected for printing by surface tension reduction techniques.

2. Background Art

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop-on-demand ink jet. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Other types of piezoelectric drop-on-demand printers utilize piezoelectric crystals in push mode, shear mode, and squeeze mode. Piezoelectric drop-on-demand printers have achieved commercial success at image resolutions up to 720 dpi for home and office printers. However, piezoelectric printing mechanisms usually require complex high voltage drive circuitry and bulky piezoelectric crystal arrays, which are disadvantageous in regard to manufacturability and performance.

Great Britain Patent No. 2,007,162, which issued to Endo et al. in 1979, discloses an electrothermal drop-on-demand ink jet printer which applies a power pulse to an electrothermal heater which is in thermal contact with water based ink in a nozzle. A small quantity of ink rapidly evaporates, forming a bubble which cause drops of ink to be ejected from small apertures along the edge of the heater substrate. This technology is known as Bubblejet™ (trademark of Canon K. K. of Japan).

U.S. Pat. No. 4,490,728, which issued to Vaught et al. in 1982, discloses an electrothermal drop ejection system which also operates by bubble formation to eject drops in a direction normal to the plane of the heater substrate. As used herein, the term "thermal ink jet" is used to refer to both this system and system commonly known as Bubblejet™.

Thermal ink jet printing typically requires approximately 20 $\mu$J over a period of approximately 2 $\mu$s to eject each drop. The 10 Watt active power consumption of each heater is disadvantageous in itself; and also necessitates special inks, complicates the driver electronics, and precipitates deterioration of heater elements. In thermal printers, the heaters are typically located within the body of the droplet. See for example U.S. Pat. Nos. 4,894,664, No. 4,922,265, and No. 5,097,275. In such devices, however, the heaters are far away from the surface of the ink; as their purpose is to evaporate the ink in their neighborhood, with the resultant steam bubble propelling the ink above it towards the receiving media, which is some distance away.

U.S. Pat. No. 4,275,290, which issued to Cielo et al., discloses a liquid ink printing system in which ink is supplied to a reservoir at a predetermined pressure and retained in orifices by surface tension until the surface tension is reduced by heat from an electrically energized resistive heater, which causes ink to issue from the orifice and to thereby contact a paper receiver. This system requires that the ink be designed so as to exhibit a change, preferably large, in surface tension with temperature.

U.S. Pat. No. 4,164,745, which also issued to Cielo et al., discloses a related liquid ink printing system in which ink is supplied to a reservoir at a predetermined pressure but does not issue from the orifice (or issues only slowly) due to a high ink viscosity. When ink is desired to be released (or when a greater amount of ink is desired to be released), the ink viscosity is reduced by heat from an electrically energized resistive heater, which causes ink to issue from the orifice and to thereby contact a paper receiver. This system requires that the ink be designed so as to exhibit a change, preferably large, in ink viscosity with temperature.

U.S. Pat. No. 4,166,277, which also issued to Cielo et al., discloses a related liquid ink printing system in which ink is supplied to a reservoir at a predetermined pressure and retained in orifices by surface tension. The surface tension is overcome by the electrostatic force produced by a voltage applied to one or more electrodes which lie in an array above the ink orifices, causing ink to be ejected from selected orifices and to contact a paper receiver. The extent of ejection is claimed to be very small in the above Cielo patents, as opposed to an "ink jet", contact with the paper being the primary means of printing an ink drop. This system is disadvantageous, in that a plurality of high voltages must be controlled and communicated to the electrode array. Also, the electric fields between neighboring electrodes interfere with one another. Further, the fields required are larger than desired to prevent arcing, and the variable characteristics of the paper receiver such as thickness or dampness can cause the applied field to vary.

In U.S. Pat. No. 4,293,865, which issued to Jinnai et al, a voltage applied to an electromechanical transducer in an ink channel below the ink orifice causes a meniscus to protrude but insufficiently to provide drop ejection. When, in addition, a voltage is applied to an opposing electrode above the ink orifice, ink from a protruding meniscus is caused by the electrostatic force to eject a drop of ink from the orifice which subsequently travels to a paper receiver. Ink from a meniscus not caused to protrude is not caused by the electrostatic force to be ejected. Various combinations of electromechanical transducers and electrostatic fields which act in combination to eject ink drops are similarly disclosed. This method is disadvantageous in that the fabrication of such transducer arrays is expensive and difficult.

In U.S. Pat. No. 4,751,531, which issued to Saito, a heater is located below the meniscus of ink contained between two opposing walls. The heater causes, in conjunction with an electrostatic field applied by an electrode located near the heater, the ejection of an ink drop. There are a plurality of heater/electrode pairs, but there is no orifice array. The force on the ink causing drop ejection is produced by the electric field, but this force is alone insufficient to cause drop ejection. That is, the heat from the heater is also required to reduce either the viscous drag and/or the surface tension of the ink in the vicinity of the heater before the electric field force is sufficient to cause drop ejection. The use of an electrostatic force alone requires high voltages. This system is thus disadvantageous in that a plurality of high voltages must be controlled and communicated to the electrode array.

Also the lack of an orifice array reduces the density and controllability of ejected drops.

Other ink jet printing systems have also been described in technical literature, but are not currently used on a commercial basis. For example, U.S. Pat. Nos. 4,737,803 and No. 4,748,458 disclose ink jet recording systems wherein the coincident address of ink in printhead nozzles with heat pulses and an electrostaticly attractive field cause ejection of ink drops to a print sheet.

Each of the above-described ink jet printing systems has advantages and disadvantages. However, there remains a widely recognized need for an improved ink jet printing, approach, providing advantages for example, as to cost, speed, quality, reliability, power usage, simplicity of construction and operation, durability and consumables.

Commonly assigned U.S. Pat. application Ser. No. 08/621,754 filed in the name of Kia Silverbrook on Mar. 22, 1996, discloses a liquid printing system that affords significant improvements toward overcoming the prior art problems associated with drop size and placement accuracy, attainable printing speeds, power usage, durability, thermal stresses, other printer performance characteristics, manufacturability, and characteristics of useful inks. FIG. 1 shows a single microscopic nozzle tip according to the Silverbrook disclosure. Pressurized ink 100 extends from the nozzle, which is formed from silicon dioxide layers 102 with a heater 103 and a nozzle tip 104. The nozzle tip is passivated with silicon nitride. Heaters described by Silverbrook are simple in design, and they are optimum for fluid flow. However, a considerable amount of the thermal energy that they produce is lost to the ambient, to the ink reservoir, and to the substrate. Only a small portion actually heats the surface of the meniscus. Because the heat is applied where the ink volume is small, ink evaporation occurs; resulting in a build up of residue in the lip area of the heater that may eventually lead to wicking or runoff.

DISCLOSURE OF THE INVENTION

It is an object of the present invention to provide a drop-on-demand printhead wherein a mechanism of selecting drops to be printed produces a difference in position between selected drops and drops which are not selected, but which is insufficient to cause the selected ink drops to overcome the ink surface tension and separate from the body of the ink in the printhead, wherein an additional means is provided to cause separation of the selected drops, and wherein a maximum of the thermal energy that is produced is applied to the ink volume.

According to the present invention, the heater is suspended in the body of the ink meniscus close to its surface when the meniscus is at its equilibrium position prior to being addressed. The heater serves to heat the surface and to reduce its surface tension. The pressure applied to the ink reservoir then forces the meniscus to expand.

Since the heater is located within the body of the meniscus and since, during operation, the pressure forces the heated ink towards the surface, most of the energy is utilized to keep the surface at elevated temperature, which is the desired effect. Very little thermal energy is lost to the ink supply or to the substrate. Furthermore, since the heat is applied to where the volume of the ink is large, minimum evaporation occurs. Since the ink in the lip area remains fairly cool, the lip surface remains clean of residue, thus preventing wicking or runoff.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
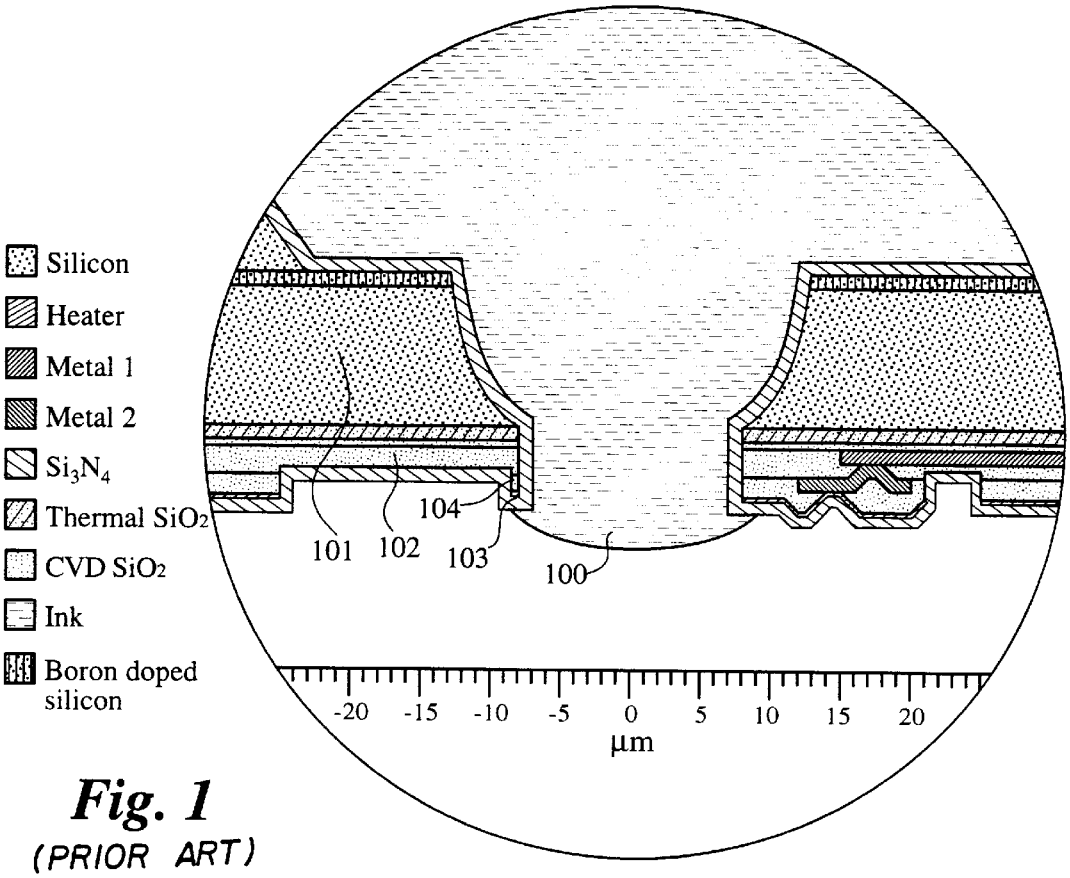
Fig. 1 (PRIOR ART)
FIG. 1 is a cross section of a nozzle tip according to a prior invention.

The present description will be directed in particular to elements forming part of, or cooperating more directly with, apparatus in accordance with the present invention. It is to be understood that elements not specifically shown or described may take various forms well known to those skilled in the art.

One important feature of the present invention is a novel mechanism for significantly reducing the energy required to select which ink drops are to be printed. This is achieved by separating the mechanism for selecting ink drops from the mechanism for ensuring that selected drops separate from the body of ink and form dots on a recording medium. Only the drop selection mechanism must be driven by individual signals to each nozzle. The drop separation mechanism can be a field or condition applied simultaneously to all nozzles. The drop selection mechanism is only required to create sufficient change in the position of selected drops that the drop separation mechanism can discriminate between selected and un-selected drops.

The following table entitled "Drop separation means" shows some of the possible methods for separating selected drops from the body of ink, and ensuring that the selected drops form dots on the printing medium. The drop separation means discriminates between selected drops and un-selected drops to ensure that un-selected drops do not form dots on the printing medium.

Drop separation means

| Means | Advantage | Limitation |
|---|---|---|
| 1. Electrostatic attraction | Can print on rough surfaces, simple implementation | Requires high voltage power supply |
| 2. AC electric field | Higher field strength is possible than electrostatic, operating margins can be increased, ink pressure reduced, and dust accumulation is reduced | Requires high voltage AC power supply synchronized to drop ejection phase. Multiple drop phase operation is difficult |
| 3. Proximity (printhead in close proximity to, but not touching, recording medium) | Very small spot sizes can be achieved. Very low power dissipation. High drop position accuracy | Requires print medium to be very close to printhead surface, not suitable for rough print media, usually requires transfer roller or belt |

-continued

| Drop separation means | | |
|---|---|---|
| Means | Advantage | Limitation |
| 4. Transfer Proximity (print-head is in close proximity to a transfer roller or belt | Very small spot sizes can be achieved, very low power dissipation, high accuracy, can print on rough paper | Not compact due to size of transfer roller or transfer belt. |
| 5. Proximity with oscillating ink pressure | Useful for hot melt inks using viscosity reduction drop selection method, reduces possibility of nozzle clogging, can use pigments instead of dyes | Requires print medium to be very close to print-head surface, not suitable for rough print media. Requires ink pressure oscillation apparatus |
| 6. Magnetic attraction | Can print on rough surfaces. Low power if permanent magnets are used | Requires uniform high magnetic field strength, requires magnetic ink |

Other drop separation means may also be used. The preferred drop separation means depends upon the intended use. For most applications, method 1: "Electrostatic attraction", or method 2: "AC electric field" are most appropriate. For applications where smooth coated paper or film is used, and very high speed is not essential, method 3: "Proximity" may be appropriate. For high speed, high quality systems, method 4: "Transfer proximity" can be used. Method 6: "Magnetic attraction" is appropriate for portable printing systems where the print medium is too rough for proximity printing, and the high voltages required for electrostatic drop separation are undesirable. There is no clear 'best' drop separation means which is applicable to all circumstances.

Figure 2:
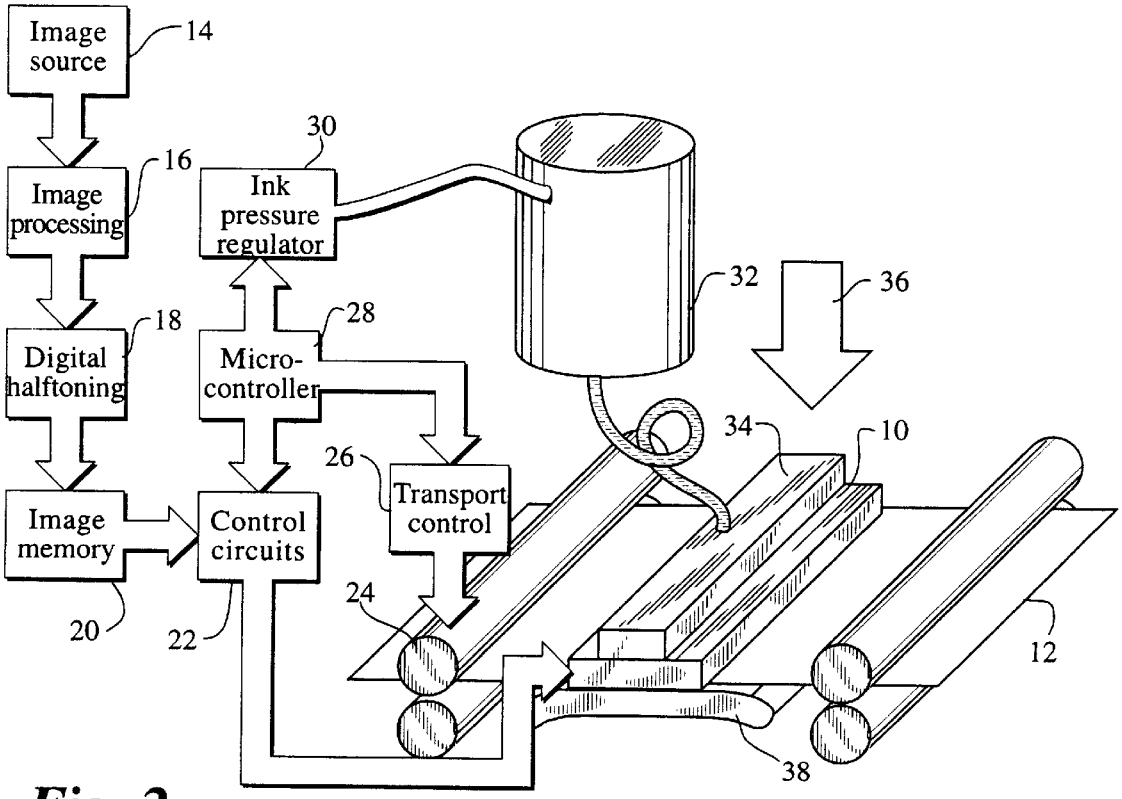
FIG. 2 is a simplified block schematic diagram of one exemplary printing apparatus according to the present invention.

A simplified schematic diagram of one preferred printing system according to the invention appears in FIG. 2. A printhead 10 and recording media 12 are associated with an image source 14, which may be raster image data from a scanner or computer, outline image data in the form of a page description language, or other forms of digital image representation. The image data is converted to a pixel-mapped page image by an image processing unit 16. This may be a raster image processor in the case of page description language image data, or may be pixel image manipulation in the case of raster image data. Continuous tone data produced by image processing unit 16 is halftoned by a digital halftoning unit 18. Halftoned bitmap image data is stored in a full page or band image memory 20. Control circuits 22 read data from image memory 20 and apply time-varying electrical pulses to selected nozzles that are part of printhead 10. These pulses are applied at an appropriate time, and to the appropriate nozzle, so that selected drops will form spots on recording medium 12 in the appropriate position designated by the data in image memory 20.

Recording medium 12 is moved relative to printhead 10 by a media transport system 24, which is electronically controlled by a media transport control system 26, which in turn is controlled by a microcontroller 28. In the case of pagewidth printheads, it is most convenient to move recording media 12 past a stationary printhead. However, in the case of scanning print systems, it is usually most convenient to move the printhead along one axis (the sub-scanning direction) and the recording medium along the orthogonal axis (the main scanning direction), in a relative raster motion. Microcontroller 28 may also control an ink pressure regulator 30 and control circuits 22.

Ink is contained in an ink reservoir 32 under pressure. In the quiescent state (with no ink drop ejected), the ink pressure is insufficient to overcome the ink surface tension and eject a drop. A constant ink pressure can be achieved by applying pressure to ink reservoir 32 under the control of ink pressure regulator 30. Alternatively, for larger printing systems, the ink pressure can be very accurately generated and controlled by situating the top surface of the ink in reservoir 32 an appropriate distance above printhead 10. This ink level can be regulated by a simple float valve (not shown).

Ink is distributed to the back surface of printhead 10 by an ink channel device 34. The ink preferably flows through slots and/or holes etched through a silicon substrate of the printhead to the front surface, where the nozzles and actuators are situated.

In some types of printers according to the invention, an external field 36 is required to ensure that the selected drop separates from the body of the ink and moves towards recording medium 12. A convenient external field 36 is a constant electric field, as the ink is easily made to be electrically conductive. In this case, a paper guide (or platen) 38 can be made of electrically conductive material and used as one electrode generating the electric field. The other electrode can be printhead 10 itself. Another embodiment uses proximity of the print medium as a means of discriminating between selected drops and un-selected drops.

For small drop sizes, gravitational force on the ink drop is very small; approximately $10^{-4}$ of the surface tension forces. Thus, gravity can be ignored in most cases. This allows printhead 10 and recording medium 12 to be oriented in any direction in relation to the local gravitational field. This is an important requirement for portable printers. When properly arranged with the drop separation means, selected drops proceed to form spots on recording medium 12, while un-selected drops remain part of the body of ink.

Figure 3:
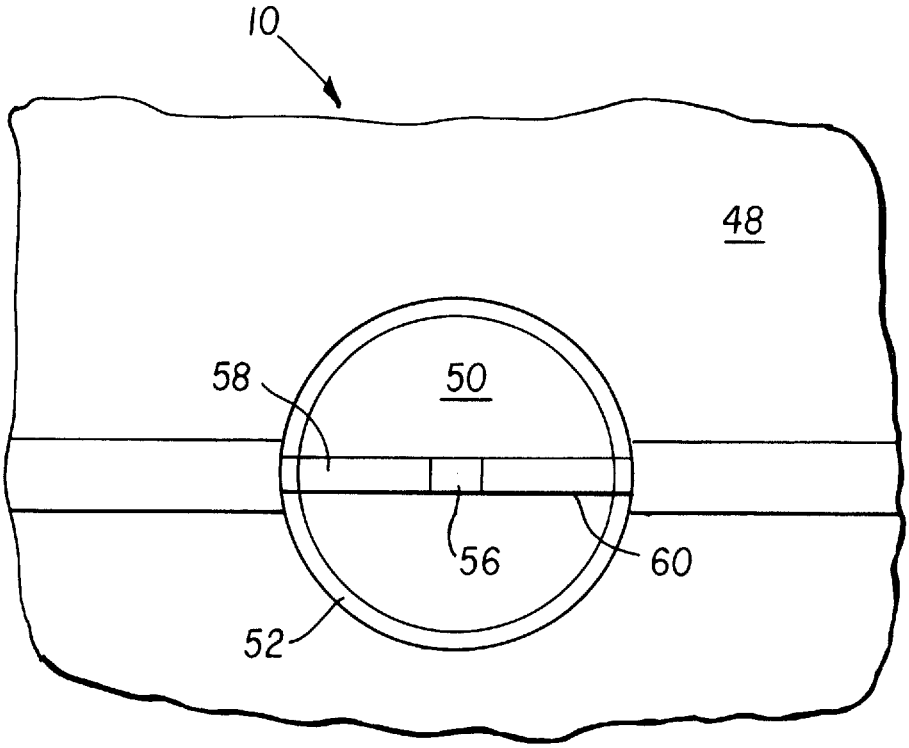
FIG. 3 is a top plan view of a drop-on-demand ink jet nozzle tip according to a preferred embodiment of the present invention.
Figure 4:
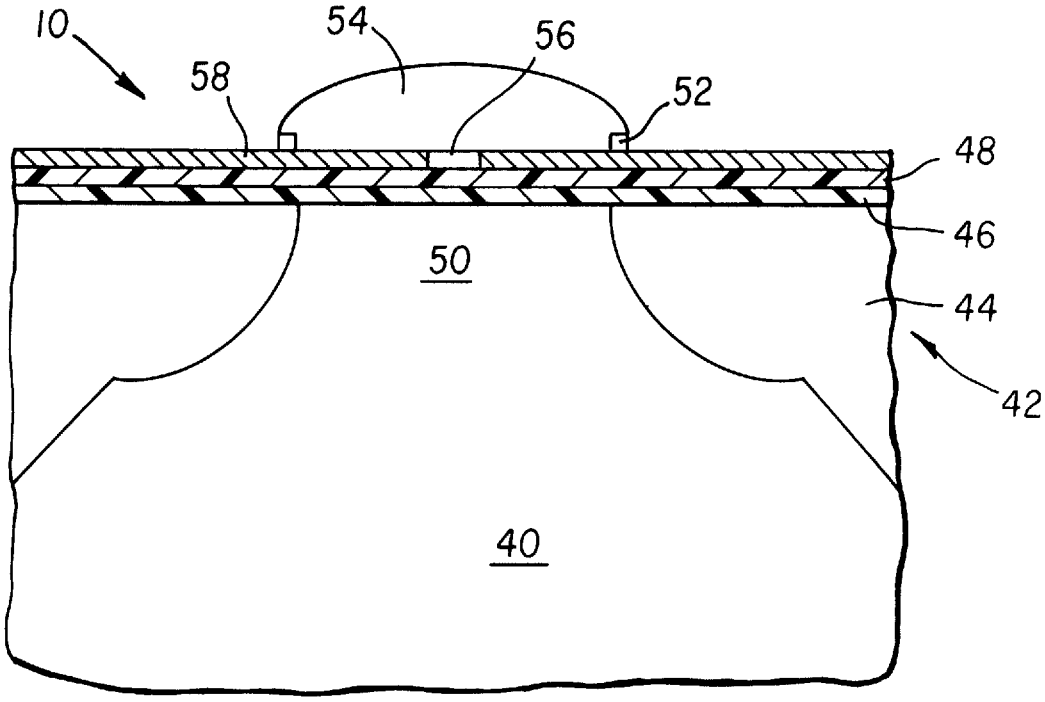
FIG. 4 is a cross section of the nozzle tip of FIG. 3.

FIGS. 3 and 4 are schematic plan and cross-sectional views, respectfully, of a drop-on-demand ink jet printhead 10 according to a preferred embodiment of the present invention. An ink delivery channel 40 is formed below an orifice plate 42. Orifice plate 42 is formed of a substrate 44 of doped silicon, an intermediate layer 46 of silicon dioxide, and a surface layer 48 of silicon nitride.

Orifice plate 42 has a plurality of orifices 50 through which ink may pass from ink delivery channel 40. Orifices 50 are also known as nozzles, and may have lips 52 which extend above the top of the orifice plate if desired.

An ink meniscus 54 is shown in FIG. 4 before selection. Ink in delivery channel 40, is at all times, pressurized above atmospheric pressure, and ink meniscus 54 therefore protrudes somewhat above orifice plate 42 at all times. The force of surface tension, which tends to hold the drop in, balances the force of the ink pressure, which tends to push the drop out of the orifice.

A heater 56 is positioned in the middle of orifice 50 and supported by a bridge structure made of thin electrical conductors 58 and 60 of polysilicon film, and of supporting thin films of silicon dioxide 46 and silicon nitride 48. Heater 56 may be made with lightly doped polysilicon, and conductors 58 and 60 may be made with heavily doped polysilicon. Such a heater is simple to fabricate when the printhead is made using silicon substrates and a CMOS process.

At ambient temperature before heater 56 is actuated, an equilibrium exists between the ink pressure, the external electrostatic field, and the surface tension of the ink, whereby no ink escapes the nozzle. In this quiescent state, meniscus 54 of the ink does not protrude significantly from the printhead surface, so the electrostatic field is not significantly concentrated at the meniscus to cause drop separation.

When the heater is energized, the ink in contact with the heater is rapidly heated. The reduction in surface tension causes the heated portion of the meniscus to rapidly expand relative to the cool ink meniscus. Convective flow rapidly transports this heat over part of the free surface of the ink at the nozzle tip. It is desirable for the heat to be distributed over the ink surface, and not just where the ink is in contact with the heater, because viscous drag against the solid heater inhibits movement of the ink directly in contact. The increase in temperature causes a decrease in surface tension, disturbing the equilibrium of forces. As the meniscus is heated, it begins to expand, because of the applied pressure, and the ink begins to flow. The ink forms a new, increasingly larger meniscus, which protrudes from the printhead. The electrostatic field becomes concentrated on the protruding conductive ink drop.

If the applied thermal energy is sufficiently large, the meniscus expands beyond a critical size, and then keeps growing even if the heat is turned off. If the heat pulse is not sufficient, the minuscus grows to a sub-critical size, and then retracts to it quinescant position when the heat is no longer applied. For a minuscus that has grown beyond its critical size, the electrostatic attraction now causes the ink drop to begin to accelerate towards the recording medium.

When the rate at which the ink is drawn from the nozzle exceeds the viscously limited rate of ink flow through the nozzle, the ink just above the nozzle begins to "neck", and the selected drop separates from the body of ink. The selected drop then travels to the recording medium under the influence of the external electrostatic field. The meniscus of the ink at the nozzle tip then returns to its quiescent position, ready for the next heat pulse to select the next ink drop. One ink drop is selected, separated and forms a spot on the recording medium for each heat pulse. As the heat pulses are electrically controlled, drop on demand ink jet operation can be achieved.

Figure 5:
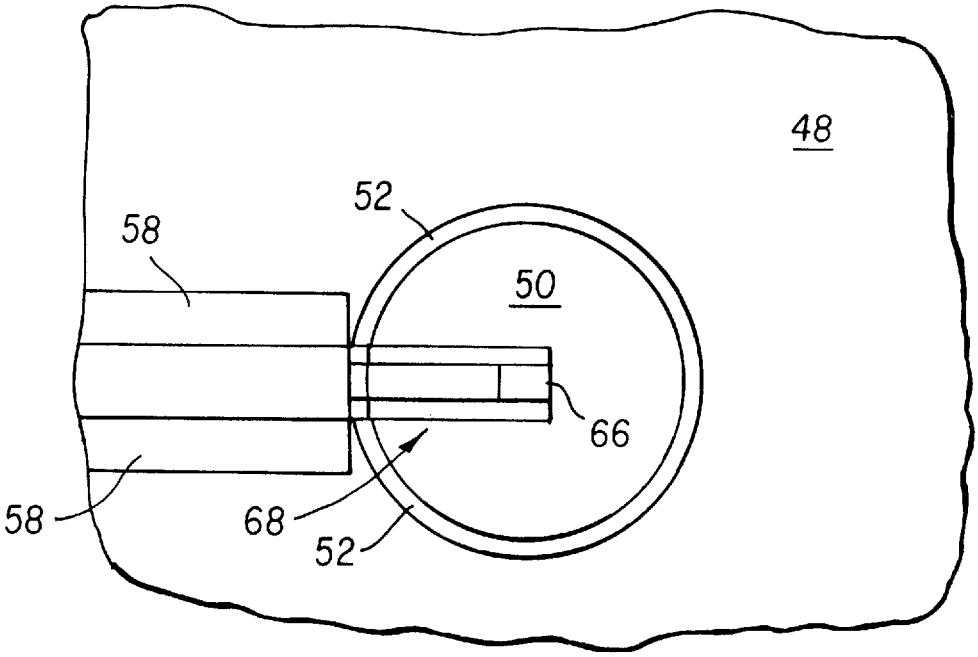
FIG. 5 is a top plan view of a drop-on-demand ink jet nozzle tip according to another preferred embodiment of the present invention.
Figure 6:
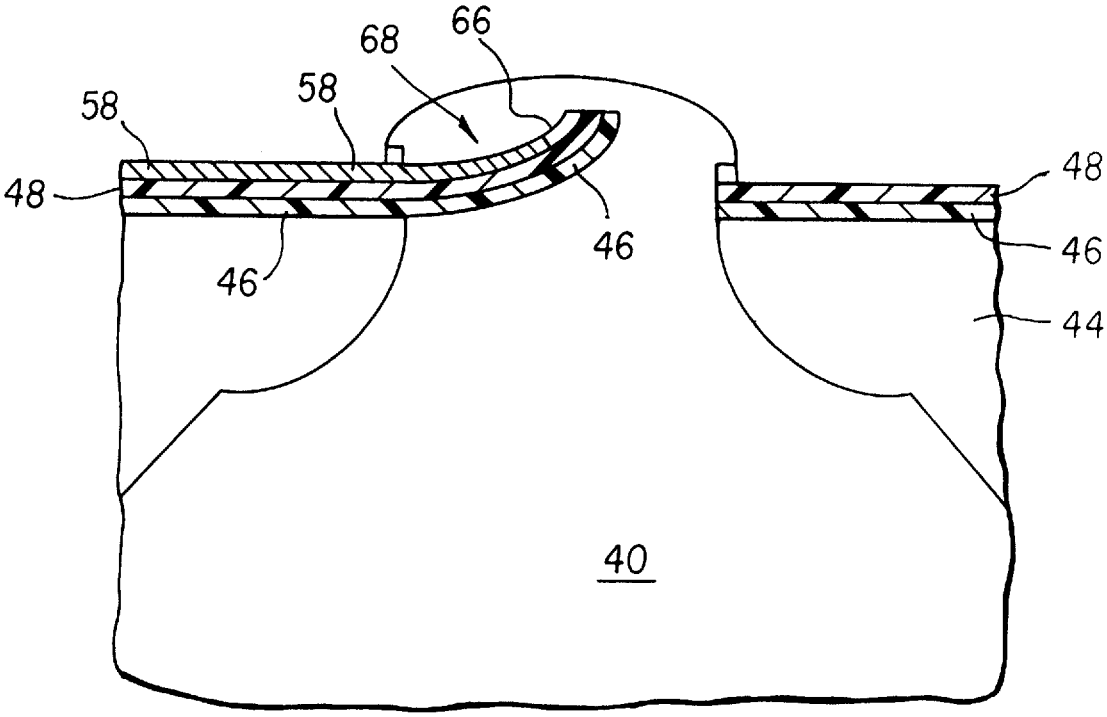
FIG. 6 is a cross section of the nozzle tip of FIG. 5.

Referring to FIGS. 5 and 6, a heater 66 is positioned at the end of a cantilever beam 68. $Si_3N_4$ layer 48 has been deposited onto oxide layer 46 with built-in tensile stress before the composit was cut to shape. When the $Si_3N_4$ layer contracts, the tip of the cantilever beam holding the heater bends upwardly as illustrated; thus allowing more efficient heating of the surface of the meniscus and more rapid formation of the droplet. The tip may be caused to bend downwardly rather than upwardly as illustrated. Further, multiple heaters may be provided along the length of cantilever beam 68.

It is to be appreciated that although a particular preferred embodiment of the method of manufacture of the device of the present invention has been described in detail, many variations of this method are possible and would be apparent to those skilled in the art of thin film processing. Likewise, many variations of the device geometry are possible consistent with the nature and principal of operation of the present device, such variants being within the scope and practice of the present invention.

What is claimed is:

1. An ink jet printhead for drop-on-demand printing, said printhead comprising:

(a) a substrate having a plurality of drop-emitter orifices;

(b) an ink channel coupled to each of said orifices for delivery of a body of ink to the orifices;

(c) pressure means for subjecting ink in said channels to a pressure above ambient pressure, thereby forming an ink meniscus at the orifices, said meniscus having a surface; and (d) drop selection means for selectively delivering heat to ink which has been delivered to selectively addressed ones of the orifices, thereby causing a difference in meniscus position between ink in addressed and non-addressed orifices, said drop selection means including a heater suspended in each ink meniscus close to the surface of the meniscus when the meniscus is at a non-addressed orifice position, said heater being effective to heat the meniscus and to thereby reduce surface tension of the meniscus at selectively addressed orifices.

2. The printhead of claim 1 further including drop separating means for causing ink from addressed orifices to separate as drops from the body of ink while allowing ink to be retained in non-addressed orifices.

3. The printhead of claim 2 wherein:

said selection means causes ink in addressed orifices to move to selected positions, retained by surface tension, but further protruding from the orifices than ink in non-addressed orifices; and said drop separating means attracts such further-protruding ink toward a print region.

4. The printhead of claim 1 in which the ink is a pigmented ink.

5. The printhead of claim 1 in which the ink is a magnetic ink.

6. The printhead of claim 1 in which the ink is an emulsion ink.

7. The printhead of claim 1 in which the ink is a microemulsion ink.

8. The printhead of claim 1 in which the heaters are suspended in each ink meniscus on electrical conductors.

9. The printhead of claim 8 in which the electrical conductors form a cantilever, and the heaters are at free ends of the cantilevers.

10. The printhead of claim 8 in which the electrical conductors form a cantilever, and there is at least one of the heaters along each of the cantilevers.

* * * * *